United States Patent [19]

Boughton et al.

[11] 3,972,550

[45] Aug. 3, 1976

[54] ALIGNING-SECURING APPARATUS FOR A REFRIGERATOR DOOR

[75] Inventors: Stephen G. Boughton, Louisville, Ky.; James D. Wilkerson, Jr., Bloomington, Ind.

[73] Assignee: General Electric Company, Louisville, Ky.

[22] Filed: Feb. 12, 1975

[21] Appl. No.: 549,178

[52] U.S. Cl. ..... 292/288; 24/208 A; 206/320; 292/DIG. 71; 312/138 R

[51] Int. Cl.[2] ..... E05B 65/52; E05B 65/06

[58] Field of Search ..... 312/263, 245, 333, 138; 206/320; 24/DIG. 17, DIG. 16, 213 R, 208 A; 292/DIG. 71, 17, 70, 288

[56] References Cited

UNITED STATES PATENTS

| | | | |
|---|---|---|---|
| 417,805 | 12/1889 | Beaman | 248/475 R |
| 2,885,237 | 5/1959 | Heyer | 292/70 |
| 3,309,096 | 3/1967 | Inka | 24/DIG. 17 |
| 3,621,684 | 11/1971 | Horvay et al. | 292/DIG. 71 |

FOREIGN PATENTS OR APPLICATIONS

| | | | |
|---|---|---|---|
| 143,542 | 9/1951 | Australia | 292/70 |

*Primary Examiner*—Paul R. Gilliam
*Assistant Examiner*—Alex Grosz
*Attorney, Agent, or Firm*—Francis H. Boos

[57] ABSTRACT

An aligning-securing apparatus has holding elements that are inserted in respective openings of a refrigerator cabinet and a refrigerator door. In the installed position, the apparatus maintains the door aligned relative to the refrigerator cabinet during installation of the door on the cabinet and releasably maintains the door against vertical movement during shipping of the refrigerator.

4 Claims, 5 Drawing Figures

ALIGNING-SECURING APPARATUS FOR A REFRIGERATOR DOOR

BACKGROUND OF THE INVENTION

During installation of a door on a cabinet of a household refrigerator, it is often difficult to maintain the door at a preselected location while attaching the door hinges. Further, it has been found that, during shipping, the refrigerator is sometimes subjected to such severe impacts that the unhinged edge of the door moves vertically with resultant damage to the refrigerator cabinet, the door, and/or the hinge.

In order to protect the refrigerator from damage during shipment, various packaging systems have been employed such as taping and/or placing cardboard supports under the door.

Although these heretofore utilized packaging systems have been partially successful in reducing shipping damage, the weight of the door is often sufficient to break the tape, crush the cardboard supports and free the door for damaging movement during severe impacts.

By providing the apparatus of this invention, the doors are sufficiently supported to substantially, completely restrain the door against vertical movement and resultant damage during shipping. Further, it has been discovered that the apparatus can be utilized during installation of the door hinges to assure proper alignment of the door relative to the refrigerator cabinet.

SUMMARY OF THE INVENTION

In accordance with this invention, a door of a household refrigerator is aligned and maintained in alignment during shipping of the refrigerator by an aligning-securing element. The refrigerator cabinet and door each have an opening for receiving a respective holding element of the aligning-securing element in the aligned position of the door on the refrigerator cabinet. The aligning-securing element has a flange having first and second opposed surfaces. A first holding element extends outwardly from the first surface of the flange and is of a size sufficient for insertion into and frictionally, releasably maintaining the aligning-securing element in the opening of the refrigerator cabinet. A second holding element extends outwardly from the second surface of the flange and is of a size sufficient for insertion into and frictionally, releasably maintaining the aligning-securing element in the opening of the door and the door preselectively aligned and maintained against vertical movement relative to the refrigerator cabinet.

DETAILED DESCRIPTION OF THE INVENTION

Figure 1:
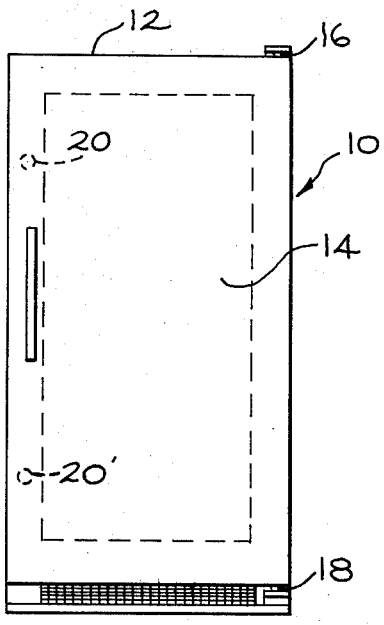
FIG. 1 is a diagrammatic frontal view of a household refrigerator having the apparatus of this invention.

In the embodiment of FIG. 1, a household refrigerator 10 has a refrigerator cabinet 12 and a door 14 covering an access opening of the cabinet. The door 14 is connected to the cabinet 12 by hinges 16, 18, as is known in the art. One or more of the aligning-securing elements 20, 20' of this invention are associated with the door 14 and the cabinet 12 for aligning the door 14 relative to the cabinet 12 during installation of the door 14 on the cabinet 12 and/or maintaining the door in the preselected alignment during shipping of the refrigerator 10.

Figure 2:
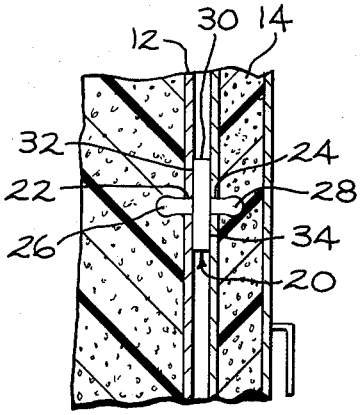
FIG. 2 is a diagrammatic, partially sectioned view of a portion of the refrigerator of FIG. 1.

Referring to FIG. 2, the refrigerator cabinet 12 and the door 14 each have a respective opening 22, 24 for receiving a respective holding element 26, 28 in the aligned position of the door 14 on the cabinet 12.

The aligning-securing element 20 of this invention has a flange 30 which has first and second opposed surfaces 32, 34. The first holding element 26 extends outwardly from the first surface 32 of the flange 30 and the second holding element 28 extends outwardly from the opposed second surface 34 of the flange 30.

The first and second holding elements 26, 28 are each of a size sufficient for insertion into and releasably, frictionally maintaining the holding elements 26, 28 in their respective openings 22, 24. In the installed position, the flange 30 abuts the outer wall of the cabinet 12 and the inner wall of the door 14 and prevents longitudinal rotation or canting of the aligning-securing element 20. If the longitudinal rotation or canting were not prevented, the door 14 could be moved from alignment.

Figure 3:
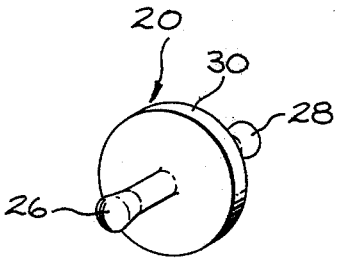
FIG. 3 is a perspective view of one embodiment of the apparatus of this invention.

In the embodiment of FIG. 3, the flange 30 is of a circular configuration and the holding elements 26, 28 are each substantially coaxially positioned relative to the flange 30.

Figure 4:
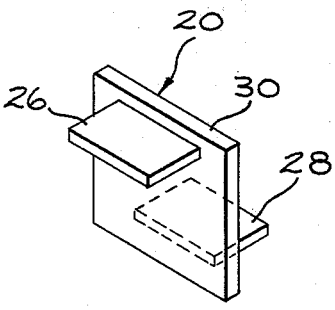
FIG. 4 is a perspective view of another embodiment of the apparatus of this invention.

In the embodiment of FIG. 4, the flange 30 is of a square configuration and the holding elements 26, 28 are each spaced from a central axis, are of rectangular configuration and are insertable into rectangular openings which are likewise spaced from the central axis.

Figure 5:
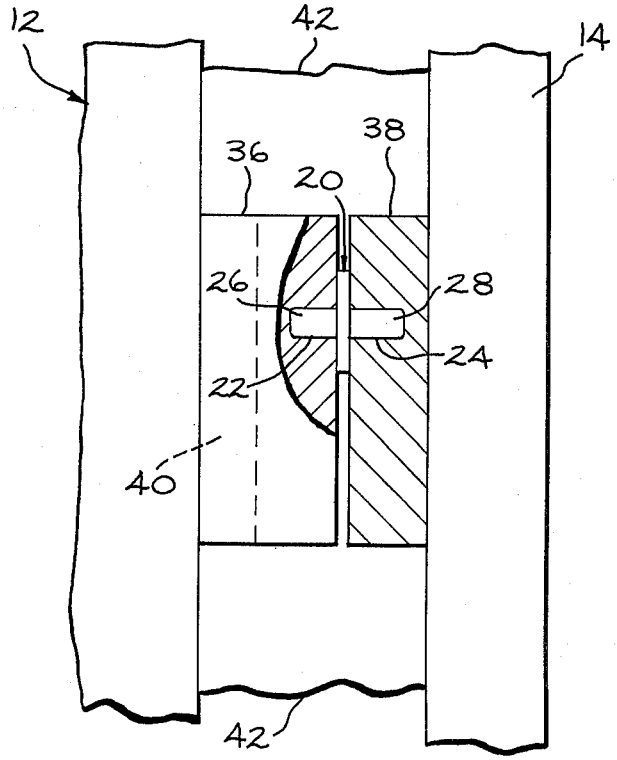
FIG. 5 is a diagrammatic, partially sectioned view of a portion of a refrigerator cabinet and door having another embodiment of this invention installed thereon.

In the embodiment of FIG. 5, the cabinet 12 comprises a first support plate 36 and the door 14 comprises a second support plate 38. Each of the support plates 36, 38 have the respective openings 22, 24 for receiving the respective holding elements 26, 28. These plates 36, 38 are known in the art and are utilized in a magnet closure system for maintaining a magnet 40 with the cabinet 12 and providing an offset for accommodating a relatively thick refrigerator gasket 42.

The support plate 36, 38 can be attached to the respective cabinet 12 and door 14 by any means known in the art as, for example, by welding.

The holding elements 26, 28 can be of any material having sufficient strength to resist the impact forces to which they are expected to be subjected. One example of material that has been found highly satisfactory is an organic plastic material such as Acrylonitrile-Butadiene-Styrene (ABS). The holding elements 26, 28 can also be formed of a deformable material such as rubber and be of a size greater than the respective opening for increasing the frictional connection of the holding element 20.

In the operation of the aligning-securing element 20 of this invention, the first holding element 26 is installed in the cabinet opening 22, the door 14 is raised, and the second holding element 28 is inserted into the door opening 24. At this position, one end of the door 14 is aligned and maintained relative to the cabinet 12, while the hinges 16, 18 are attached. The aligning-securing element 20 is thereafter maintained in this installed position for maintaining the door against vertical movement during shipping of the refrigerator 10.

After the refrigerator 10 is installed in the user's home, the aligning-securing element 20 is removed and either discarded or retained for subsequent use.

By so constructing and utilizing the apparatus of this invention, the labor required to prepare a refrigerator for shipping is reduced. Referigerator damage during shipping with resultant waste of material and labor is also reduced.

Other modifications and alterations of this invention will become apparent to those skilled in the art from the foregoing discussion, and it should be understood that this invention is not to be unduly limited thereto.

What is claimed is:

1. Apparatus comprising:

a household refrigerator having a cabinet and a door, said cabinet and door having openings positioned at preselected locations relative one to the other in the aligned position of the door on the refrigerator cabinet;

an aligning-securing element for aligning and for maintaining said door in alignment during shipping of said refrigerator, said aligning-securing element having a flange and first and second holding elements, said first holding element extending outwardly from a first surface of the flange and being of a size sufficient for insertion into and for being frictionally, releasably maintained in the opening of the cabinet with said first flange surface abutting the outer wall of the cabinet, and said second holding element extending outwardly from an opposed second surface of the flange and being of a size sufficient for insertion into and for being frictionally, releasably maintained in the opening of the door with said second flange surface abutting the inner wall of the door, whereby the door is preselectively aligned and maintained against vertical movement relative to the cabinet.

2. Apparatus, as set forth in claim 1, including a first support plate attached to the refrigerator cabinet and having an opening for receiving the first holding element and a second support plate attached to the door and having an opening for receiving the second holding element.

3. Apparatus, as set forth in claim 1, wherein the first and second holding elements are formed of a deformable material and are of a size greater than the respective opening.

4. Apparatus, as set forth in claim 1, wherein the first and second holding elements are formed of organic plastic material.

* * * * *